US010571170B2

(12) United States Patent
Hagler et al.

(10) Patent No.: US 10,571,170 B2
(45) Date of Patent: Feb. 25, 2020

(54) COOLING SYSTEM

(71) Applicant: Heatcraft Refrigeration Products LLC, Stone Mountain, GA (US)

(72) Inventors: Dennis Hagler, Midland, GA (US); Carlton Wilkerson, Columbus, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 121 days.

(21) Appl. No.: 15/968,398

(22) Filed: May 1, 2018

(65) Prior Publication Data

US 2019/0338991 A1 Nov. 7, 2019

(51) Int. Cl.

*F25B 41/04* (2006.01)
*F25B 40/02* (2006.01)
*F25B 49/02* (2006.01)

(52) U.S. Cl.

CPC ..... *F25B 41/04* (2013.01); *F25B 40/02* (2013.01); *F25B 49/02* (2013.01); *F25B 2400/0417* (2013.01); *F25B 2400/16* (2013.01); *F25B 2500/29* (2013.01); *F25B 2500/31* (2013.01)

(58) Field of Classification Search

CPC ..... F25B 41/04; F25B 40/02; F25B 49/02; F25B 2500/31; F25B 2400/0417; F25B 2400/16; F25B 2500/29

See application file for complete search history.

(56) References Cited

U.S. PATENT DOCUMENTS

2004/0206110 A1 10/2004 Lifson et al.
2018/0231290 A1* 8/2018 Zimmermann ..... F25B 49/02

FOREIGN PATENT DOCUMENTS

CN 103225935 A 7/2013
JP 06337172 12/1994

OTHER PUBLICATIONS

European Patent Office, Extended European Search Report, Application No. 19169836.4, dated Aug. 8, 2019, 9 pages.

* cited by examiner

*Primary Examiner* — Emmanuel E Duke
(74) *Attorney, Agent, or Firm* — Baker Botts L.L.P.

(57) ABSTRACT

An apparatus includes a heat exchanger, a load, a compressor, and a valve. The heat exchanger receives a refrigerant at a first inlet and directs the refrigerant received at the first inlet to an outlet. The load uses the refrigerant from the outlet to remove heat from a space proximate the load. The compressor compresses the refrigerant from the load. The valve directs the refrigerant from the compressor to a second inlet of the heat exchanger when a temperature of the refrigerant at the load is below a first threshold. The heat exchanger transfers heat from the refrigerant received at the second inlet to the refrigerant received at the first inlet.

21 Claims, 3 Drawing Sheets

COOLING SYSTEM

TECHNICAL FIELD

This disclosure relates generally to a cooling system, such as a refrigeration system.

BACKGROUND

Cooling systems are used to cool spaces, such as residential dwellings, commercial buildings, and/or refrigeration units. These systems cycle a refrigerant (also referred to as charge) that is used to cool the spaces.

SUMMARY OF THE DISCLOSURE

Cooling systems are used to cool spaces, such as residential dwellings, commercial buildings, and/or refrigeration units. These systems cycle a refrigerant (also referred to as charge) that is used to cool the spaces. In practice, it is beneficial for the refrigerant to be at a particular temperature when used to cool spaces to optimize the performance of the cooling system. However, in certain installations, it may be challenging to maintain the refrigerant at that temperature. For example, ambient (e.g., external) temperatures may make it more difficult to maintain the refrigerant at a particular temperature. If the ambient temperature is warm, then the refrigerant temperature may be too high. If the ambient temperature is cold, then the refrigerant temperature may be too low.

In existing installations, a subcooler is used to cool the refrigerant when the temperature of the refrigerant is too high. The subcooler is useful when the ambient temperature is warm because the subcooler can reduce the temperature of the refrigerant to optimize the performance of the cooling system. However, the subcooler does not raise the temperature of the refrigerant. Thus, when the cooling system is installed in a cold climate, the ambient temperature may reduce the refrigerant temperature beyond the point at which the cooling system performs optimally.

This disclosure contemplates an unconventional cooling system that detects the temperature of a refrigerant at a load and then heats or cools the refrigerant to a particular temperature. The system includes a subcooler heat exchanger that cools the refrigerant when the refrigerant is too warm. The heat exchanger also transfers heat from a hot gas compressor discharge to the refrigerant when the refrigerant is too cold. In this manner, the system can control the temperature of the refrigerant even if the cooling system is installed in a colder climate. Certain embodiments will be described below.

According to an embodiment, an apparatus includes a heat exchanger, a load, a compressor, and a valve. The heat exchanger receives a refrigerant at a first inlet and directs the refrigerant received at the first inlet to an outlet. The load uses the refrigerant from the outlet to remove heat from a space proximate the load. The compressor compresses the refrigerant from the load. The valve directs the refrigerant from the compressor to a second inlet of the heat exchanger when a temperature of the refrigerant at the load is below a first threshold. The heat exchanger transfers heat from the refrigerant received at the second inlet to the refrigerant received at the first inlet.

According to another embodiment, a method includes receiving a refrigerant at a first inlet of a heat exchanger and directing the refrigerant received at the first inlet to an outlet of the heat exchanger. The method also includes using the refrigerant from the outlet to remove heat from a space proximate a load and compressing, by a compressor, the refrigerant from the load. The method further includes directing the refrigerant from the compressor to a second inlet of the heat exchanger when a temperature of the refrigerant at the load is below a first threshold and transferring heat from the refrigerant received at the second inlet to the refrigerant received at the first inlet.

According to yet another embodiment, a system includes a high side heat exchanger, a heat exchanger, a load, a compressor, and a valve. The high side heat exchanger removes heat from a refrigerant. The heat exchanger receives the refrigerant at a first inlet and directs the refrigerant received at the first inlet to an outlet. The load uses the refrigerant from the outlet to remove heat from a space proximate the load. The compressor compresses the refrigerant from the load. The valve directs the refrigerant from the compressor to a second inlet of the heat exchanger when a temperature of the refrigerant at the load is below a first threshold. The heat exchanger transfers heat from the refrigerant received at the second inlet to the refrigerant received at the first inlet.

Certain embodiments provide one or more technical advantages. For example, an embodiment warms a refrigerant when the temperature of the refrigerant at a load is too warm. As another example, an embodiment cools the refrigerant when the temperature of the refrigerant at a load is too cold. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
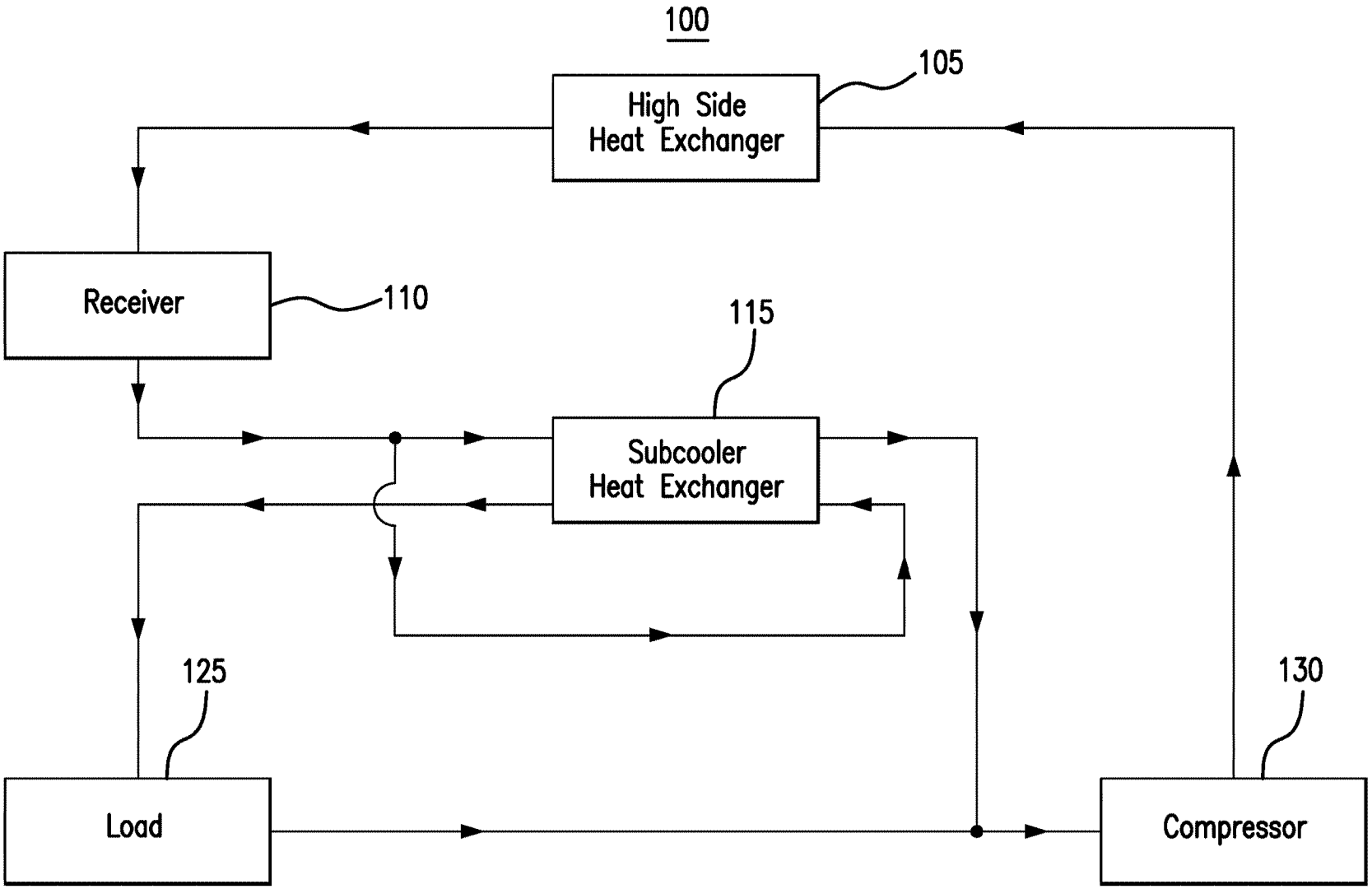
FIG. 1 illustrates portions of an example cooling system.
Figure 2:
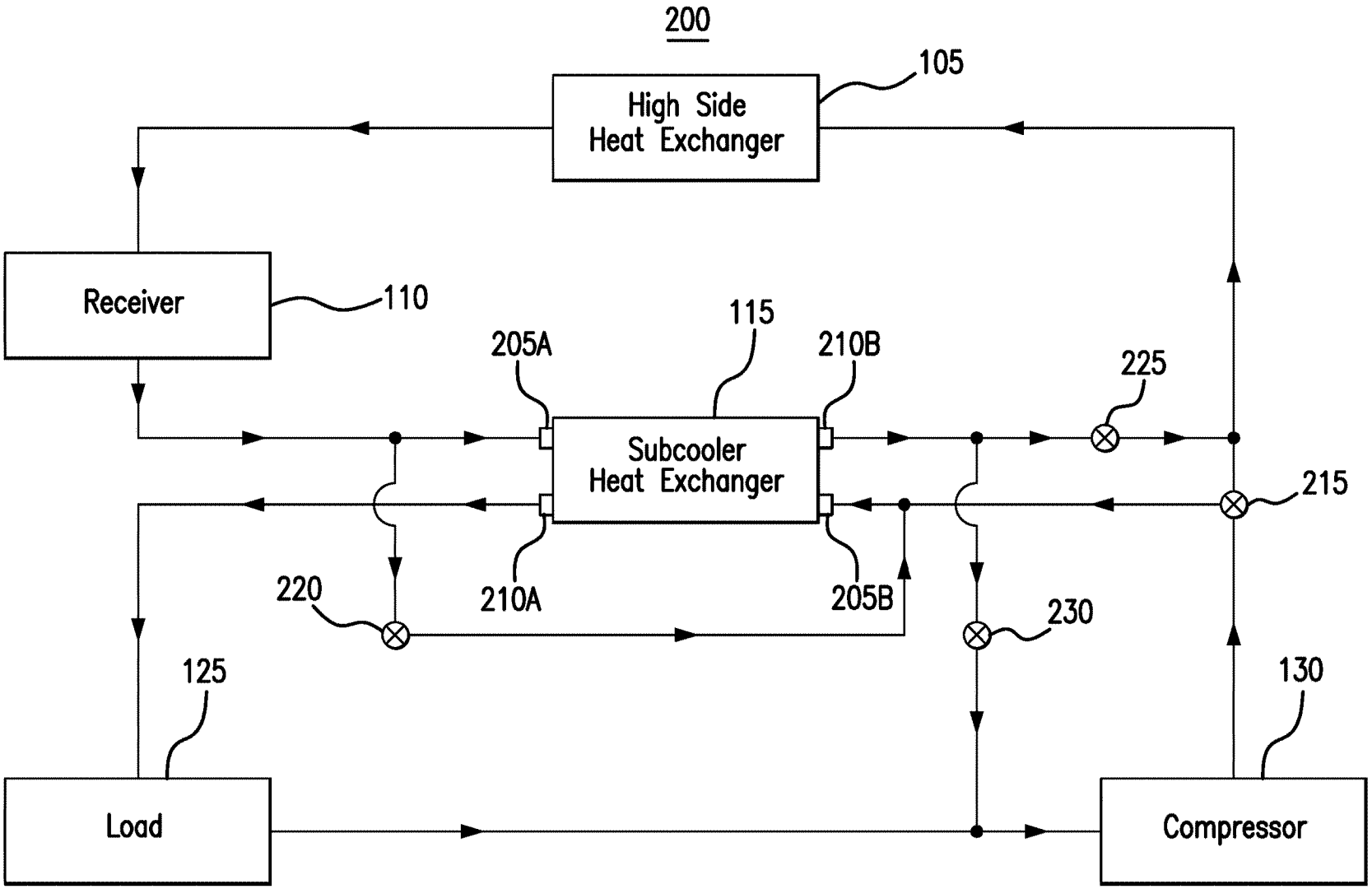
FIG. 2 illustrates portions of an example cooling system.
Figure 3:
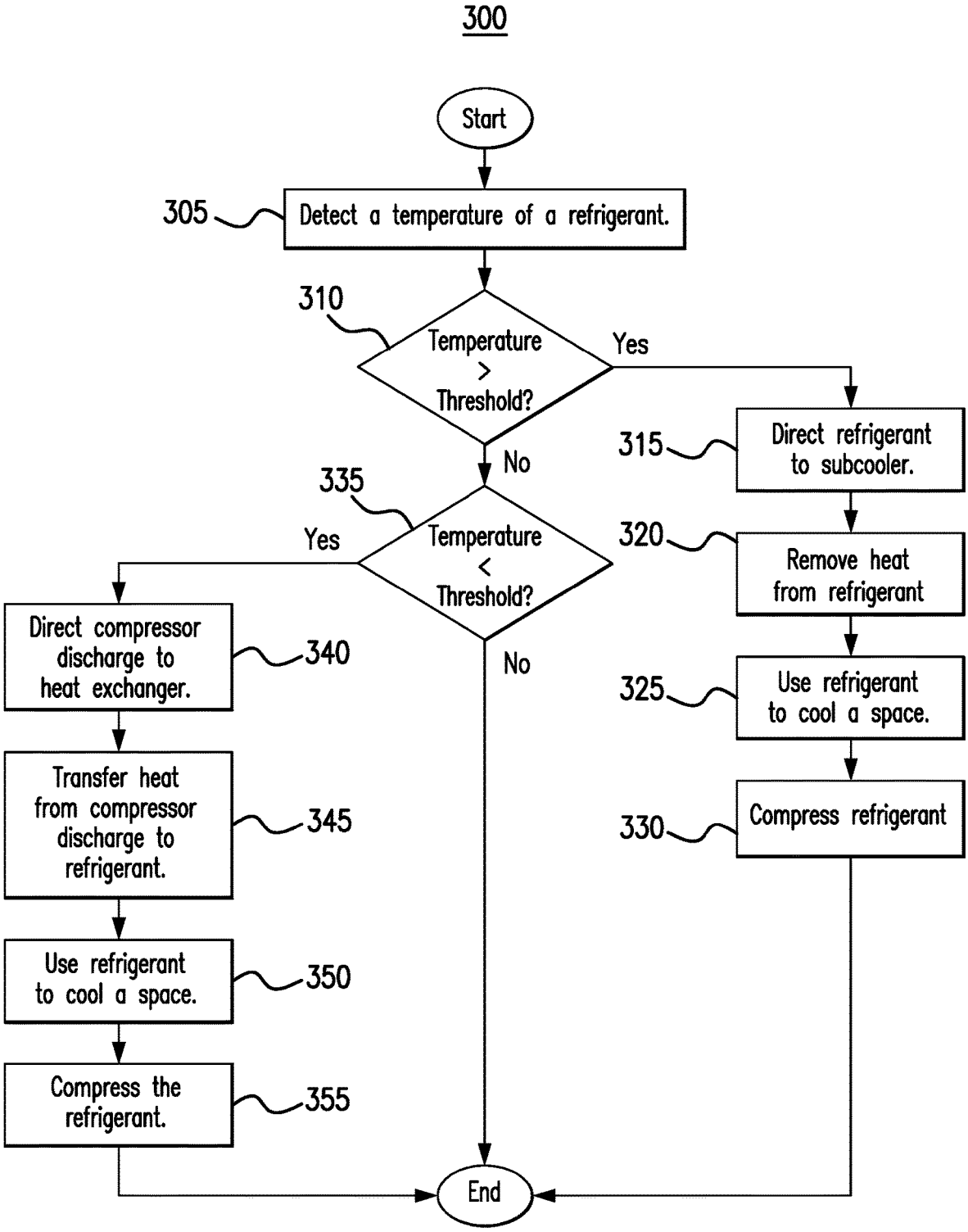
FIG. 3 is a flowchart illustrating a method for operating the cooling system of FIG. 2.

Embodiments of the present disclosure and its advantages are best understood by referring to FIGS. 1 through 3 of the drawings, like numerals being used for like and corresponding parts of the various drawings.

Cooling systems are used to cool spaces, such as residential dwellings, commercial buildings, and/or refrigeration units. These systems cycle a refrigerant (also referred to as charge) that is used to cool the spaces. In practice, it is beneficial for the refrigerant to be at a particular temperature when used to cool spaces to optimize the performance of the cooling system. However, in certain installations, it may be challenging to maintain the refrigerant at that temperature. For example, ambient (e.g., external) temperatures may make it more difficult to maintain the refrigerant at a particular temperature. If the ambient temperature is warm, then the refrigerant temperature may be too high. If the ambient temperature is cold, then the refrigerant temperature may be too low.

In existing installations, a subcooler is used to cool the refrigerant when the temperature of the refrigerant is too high. The subcooler is useful when the ambient temperature is warm because the subcooler can reduce the temperature of the refrigerant to optimize the performance of the cooling system. This subcooling system will describe in more detail using FIG. 1. The subcooler, however, does not raise the temperature of the refrigerant. Thus, when the cooling system is installed in a cold climate, the ambient temperature may reduce the refrigerant temperature beyond the point at which the cooling system performs optimally.

This disclosure contemplates an unconventional cooling system that detects the temperature of a refrigerant at a load and then heats or cools the refrigerant to a particular temperature. The system includes a subcooler heat exchanger that cools the refrigerant when the refrigerant is too warm. The heat exchanger also transfers heat from a hot gas compressor discharge to the refrigerant when the refrigerant is too cold. In this manner, the system can control the temperature of the refrigerant even if the cooling system is installed in a colder climate. The cooling system will be described in more detail using FIGS. 2 and 3.

FIG. 1 illustrates portions of an example cooling system 100. As shown in FIG. 1, system 100 includes a high side heat exchanger 105, a receiver 110, a subcooler heat exchanger 115, a load 125, and a compressor 130. Subcooler heat exchanger 115 removes heat from a refrigerant circulating in system 100 by transferring that heat into refrigerant that is redirected to compressor 130.

High side heat exchanger 105 removes heat from a refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas or changes to a liquid depending on ambient temperature. In certain configurations, high side heat exchanger 105 is positioned such that heat removed from the refrigerant is discharged into the air. For example, high side heat exchanger 105 may be positioned on a rooftop so that heat removed from the refrigerant is discharged into the air. In some configurations, the heat is transferred to a circulating water mixer.

Receiver 110 stores refrigerant received from high side heat exchanger 105. This disclosure contemplates receiver 110 storing refrigerant in any state such as, for example, a liquid state and/or a gaseous state. Refrigerant leaving receiver 110 is fed to heat exchanger 115.

Subcooler heat exchanger 115 receives refrigerant from receiver 110. The refrigerant passes through heat exchanger 115 on its way to load 125. Heat exchanger 115 is able to transfer heat to or from the refrigerant passing through heat exchanger 115. In this manner, heat exchanger 115 cools and/or warms refrigerant passing through heat exchanger 115. Heat exchanger 115 may include thermal conducting surfaces such as, for example, metal plates and/or fins that transfer heat to or from a refrigerant.

In the example of FIG. 1, heat exchanger 115 receives two flows of refrigerant from receiver 110. A first flow is received at heat exchanger 115 and directed to load 125. A second flow is received at heat exchanger 115 and directed to compressor 130. Heat exchanger 115 removes heat from refrigerant in the first flow by transferring that heat to refrigerant in the second flow. In this manner, the refrigerant in the first flow is cooled before reaching load 125.

Load 125 receives refrigerant from heat exchanger 115. When the refrigerant reaches low load 125, the refrigerant removes heat from the air around load 125. As a result, the air is cooled. The cooled air may then be circulated such as, for example, by a fan to cool a space such as, for example, a freezer and/or a refrigerated shelf. As refrigerant passes through load 125, the refrigerant may change from a liquid state to a gaseous state as it absorbs heat.

Compressor 130 compresses the refrigerant from load 125 and heat exchanger 115. This disclosure contemplates system 100 including any number of compressors 130. The compressor 130 compresses the refrigerant, thus increasing the pressure of the refrigerant. As a result, the heat in the refrigerant may become concentrated and the refrigerant may become a high pressure gas. Compressor 130 may then send the compressed refrigerant to high side heat exchanger 105.

In certain embodiments, load 125 includes a thermal expansion valve. The performance of the thermal expansion valve (and load 125) depends in part upon the temperature of the refrigerant entering the thermal expansion valve. If the refrigerant is too hot or too cold, then the thermal expansion valve may not operate optimally. In some embodiments, the thermal expansion valve operates optimally when the temperature of the refrigerant is 50 degrees Fahrenheit.

In certain instances, heat exchanger 115 operates when a temperature of the refrigerant at load 125 is above a particular temperature. In other words, heat exchanger 115 cools the refrigerant going to load 125 when that refrigerant is too warm. Heat exchanger 115 cools the refrigerant to improve the performance of system 100. Heat exchanger 115, however, does not impart heat into the refrigerant. Thus, in certain installations, when the refrigerant at load 125 is too cold, heat exchanger 115 does not increase the temperature of that refrigerant to a suitable temperature. Thus, system 100 may operate suboptimally in these installations. For example, if system 100 is installed in a cold weather climate, the cold ambient temperature may cause the refrigerant at load 125 to be too cold. Because heat exchanger 115 does not increase the temperature of the refrigerant at load 125, system 100 may operate suboptimally in the cold weather. This disclosure contemplates an unconventional cooling system that can warm the refrigerant. This unconventional system will be described in more detail using FIGS. 2 and 3.

FIG. 2 illustrates portions of an example cooling system 200. As shown in FIG. 2, system 200 includes a high side heat exchanger 105, a receiver 110, a subcooler heat exchanger 115, a load 125, a compressor 130, and valves 215, 220, 225, and 230. In particular embodiments, cooling system 200 cools a refrigerant when a temperature of the refrigerant at load 125 is too warm. Additionally, system 200 warms the refrigerant when a temperature of the refrigerant at load 125 is too cold. In this manner, system 200 can adjust the temperature of the refrigerant at load 125 to optimize the performance of system 200. However, in certain embodiments, system 200 does not include receiver 110; instead, refrigerant from high side heat exchanger 105 flows directly to heat exchanger 115.

Heat exchanger 105, receiver 110, heat exchanger 115, load 125, and compressor 130 operate similarly as those components did in system 100. For example, high side heat exchanger 105 removes heat from a refrigerant. Receiver 110 stores the refrigerant. Heat exchanger 115 transfers heat to or from the refrigerant. Load 125 uses the refrigerant to cool a space proximate load 125. Compressor 130 compresses the refrigerant.

System 200 has been configured, however, to use these components in different manners to optimize the performance of system of 200. Primarily, valves 215,220,225, and 230 can be operated to set system 200 in a cooling mode or a warming mode. In the warming mode, hot gas compressor discharge is directed to heat exchanger 115. Heat exchanger 115 then transfers heat from the hot gas to the refrigerant from receiver 110. In this manner, the refrigerant is warmed before it reaches load 125. As a result, system 200 can operate optimally, even in cold climate installations in certain embodiments.

Refrigerant from high side heat exchanger 105 and or receiver 110 flows to heat exchanger 115. Heat exchanger 115 includes a first inlet 205A and a first outlet 210A. Heat exchanger 115 also includes a second inlet 205B and a second outlet 210B. Refrigerant from high side heat exchanger 105 and/or receiver 110 flows to inlet 205A of heat exchanger 115. Heat is then transferred to or from that refrigerant. Heat exchanger 115 then directs that refrigerant to load 125 via outlet 210A. In the cooling mode, heat exchanger 115 removes heat from the refrigerant so that it is cooled before reaching load 125. In the warming mode, heat exchanger 115 adds heat to the refrigerant so that it is warmed before reaching load 125.

Additionally, in the cooling mode, refrigerant from high side heat exchanger 105 or receiver 110 is directed to inlet 205B. Heat is transferred from the refrigerant received at inlet 205A to the refrigerant received at inlet 205B. In this manner, the refrigerant received at inlet 205A is cooled before reaching load 125. The refrigerant received at inlet 205B is then directed to compressor 130.

In the warming mode, hot gas compressor discharge from compressor 130 is directed to inlet 205B. Heat is transferred from the hot gas to the refrigerant received at inlet 205A. In this manner, the refrigerant received at inlet 205A is warmed before reaching load 125. The hot gas it then directed to high side heat exchanger 105.

Valves 215, 220, 225, and 230 control the flow of refrigerant in system 200. For example, valve 215 directs hot gas compressor discharge to high side heat exchanger 105 or to inlet 205B. As another example, valve 220 can be opened to allow refrigerant to flow from receiver 110 to inlet 205B. Valves 225 and 230 control the flow of refrigerant from outlet 210B. Valve 225 and 230 can be operated to direct the refrigerant from outlet 210B either to compressor 130 or to high side heat exchanger 105. In particular embodiments, by operating valves 215, 220, 225 and 230, system 200 can cool or warm refrigerant from receiver 110 before that refrigerant reaches load 125. These two modes of operation will be described as a cooling mode and warming mode.

System 200 may include a temperature sensor near load 125. The temperature sensor detects the temperature of the refrigerant entering load 125 (or a thermal expansion valve of load 125). If the temperature of the refrigerant is below a particular threshold, such as, for example, 50 degrees Fahrenheit, then system 200 may enter a warming mode to warm the refrigerant entering load 125. If the temperature of the refrigerant is above a threshold, such as, for example, 50 degrees Fahrenheit, system 200 may enter a cooling mode to cool the refrigerant entering load 125. This disclosure contemplates using different thresholds for determining when system 200 should be in the cooling or warming modes. For example, the threshold for entering the warming mode may be 50 degrees Fahrenheit, and the threshold for entering the cooling mode may be 53 degrees Fahrenheit.

During the warming mode, system 200 transfers heat from hot gas compressor discharge to the refrigerant before the refrigerant enters load 125. As a result the refrigerant is warmed. In the warming mode, valve 215 directs hot gas compressor discharge from compressor 130 to inlet 205B. Valve 220 closes so that refrigerant does not flow to inlet 205B from receiver 110. Valve 225 opens to direct the hot gas discharge from outlet 210B to high side heat exchanger 105. Valve 230 closes to prevent the hot gas discharge from outlet 210B from flowing to compressor 130. In this manner, refrigerant flows from high side heat exchanger 105 and/or receiver 110 to heat exchanger 115. The refrigerant enters through inlet 205A of heat exchanger 115. At the same time, hot gas compressor discharge enters heat exchanger 115 through inlet 205B. Heat exchanger 115 then transfers heat from the hot gas discharge to the refrigerant. As a result, the refrigerant entering through inlet 205A warms up. That refrigerant is then directed to load 125 through outlet 210A. Heat exchanger 115 also directs the hot gas discharge to high side heat exchanger 105 through outlet 210B and valve 225. Because the refrigerant from receiver 110 is warmed before it reaches load 125, refrigerant that was too cold may be warmed to optimize the performance of system 200.

If the temperature of the refrigerant at load 125 is above a particular threshold, then the refrigerant maybe determined to be too warm. In this instance, system 200 may enter the cooling mode to cool the refrigerant before it reaches load 125. In the cooling mode, valve 215 directs hot gas compressor discharge to high side heat exchanger 105 instead of inlet 205B. Valve 220 opens to direct refrigerant from high side heat exchanger 105 and/or receiver 110 to inlet 205B. Valve 225 closes to prevent the refrigerant from outlet 210B to flow to high side heat exchanger 105. Valve 230 opens to allow the refrigerant from outlet 210B to flow to compressor 130.

In this manner, refrigerant flows from high side heat exchanger 105 and/or receiver 110 to inlet 205A of heat exchanger 115. Refrigerant also flows from high side heat exchanger 105 and/or receiver 110 to inlet 205B. Heat exchanger 115 then transfers heat from the refrigerant entering through inlet 205A to the refrigerant entering through 205B. As a result, the refrigerant entering through inlet 205A is cooled. Heat exchanger 115 then directs that refrigerant to load 125 through outlet 210A. Heat exchanger 115 also directs the refrigerant entering through inlet 205B to compressor 130 through outlet 210B and valve 230. In this manner the refrigerant flowing to load 125 is cooled, which may bring the temperature of the refrigerant closer to the threshold for entering the cooling mode.

Thus, system 200 can cool or warm a refrigerant before the refrigerant flows to load 125. As a result, system 200 can adjust the temperature of the refrigerant when the refrigerant is either too cold or too warm. By adjusting the temperature of the refrigerant, system 200 is able to optimize the performance of system 200 and/or load 125 in certain embodiments FIG. 3 is a flow chart illustrating a method 300 for operating the cooling system 200 of FIG. 2. In particular embodiments, one or more components of system 200 perform the steps of method 300. By performing method 300, system 200 can adjust a temperature of a refrigerant flowing to a load to optimize the performance of the load.

In step 305, system 200 detects a temperature of a refrigerant. In certain embodiments, system 200 may include a temperature sensor that detects the temperature of the refrigerant entering a load. In step 310, system 200 determines whether the detected temperature is greater than a threshold. System 200 may include a controller or processor that compares the detected temperature to the threshold. If the temperature is greater than the threshold, then refrigerant entering the load may be too warm, and system 200 should enter a cooling mode. In step 315, refrigerant in the system is directed to a subcooler (e.g., a subcooler heat exchanger). The heat exchanger removes heat from the refrigerant (e.g., by transferring heat from the refrigerant to a second flow of the refrigerant) in step 320. As a result, the refrigerant is cooled. The heat exchanger then directs that refrigerant to a load. In step 325, the load uses that refrigerant to cool a space. A compressor then compresses that refrigerant in step 330. By operating in the cooling mode, system 200 cools a refrigerant that is too warm before that refrigerant enters a load, thus improving the operation of the load.

If the detected temperature of the refrigerant is not greater than the threshold, then system 200 determines whether the detected temperature is less than a particular threshold in step 335. If the detected temperature of the refrigerant is less than that threshold, then the refrigerant maybe too cold and system 200 should enter a warming mode. In step 340, a valve directs hot gas compressor discharge to the heat exchanger. The heat exchanger then transfers heat from the compressor discharge to the refrigerant in step 345. As a result, the refrigerant is warmed. The heat exchanger then directs the warmed refrigerant to the load. The load uses the refrigerant to cool a space in step 350. A compressor then compresses the refrigerant in step 355. In this manner, system 200 warns refrigerant that is too cold, thus improving the performance of the load.

Modifications, additions, or omissions may be made to method 300 depicted in FIG. 3. Method 300 may include more, fewer, or other steps. For example, steps may be performed in parallel or in any suitable order. While discussed as system 200 (or components thereof) performing the steps, any suitable component of system 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a heat exchanger configured to receive a refrigerant at a first inlet and to direct the refrigerant received at the first inlet to an outlet;

a load configured to use the refrigerant from the outlet to remove heat from a space proximate the load;

a compressor configured to compress the refrigerant from the load; and a valve configured to direct the refrigerant from the compressor to a second inlet of the heat exchanger when a temperature of the refrigerant at the load is below a first threshold, the heat exchanger further configured to transfer heat from the refrigerant received at the second inlet to the refrigerant received at the first inlet.

2. The apparatus of claim 1, wherein the valve is further configured to direct the refrigerant from the compressor to a high side heat exchanger when the temperature of the refrigerant at the load is above a second threshold.

3. The apparatus of claim 1, wherein the heat exchanger is configured to:

receive the refrigerant at a second inlet of the heat exchanger when the temperature of the refrigerant at the load is above a second threshold;

transfer heat from the refrigerant received at the first inlet to the refrigerant received at the second inlet when the temperature of the refrigerant at the load is above the second threshold; and direct the refrigerant received at the second inlet to the compressor after heat from the refrigerant received at the first inlet has been transferred to the refrigerant received at the second inlet when the temperature of the refrigerant at the load is above a second threshold.

4. The apparatus of claim 3, wherein the heat exchanger comprises a valve configured to close when the temperature of the refrigerant at the load is below the first threshold.

5. The apparatus of claim 1, wherein the valve is further configured to direct the refrigerant from the compressor to the load when the temperature of the refrigerant at the load is below the first threshold.

6. The apparatus of claim 1, wherein the first threshold is 50 degrees Fahrenheit.

7. The apparatus of claim 1, further comprising a receiver configured to store the refrigerant.

8. A method comprising:

receiving a refrigerant at a first inlet of a heat exchanger;

directing the refrigerant received at the first inlet to an outlet of the heat exchanger;

using the refrigerant from the outlet to remove heat from a space proximate a load;

compressing, by a compressor, the refrigerant from the load;

directing the refrigerant from the compressor to a second inlet of the heat exchanger when a temperature of the refrigerant at the load is below a first threshold; and transferring heat from the refrigerant received at the second inlet to the refrigerant received at the first inlet.

9. The method of claim 8, further comprising directing the refrigerant from the compressor to a high side heat exchanger when the temperature of the refrigerant at the load is above a second threshold.

10. The method of claim 8, further comprising:

receiving the refrigerant at a second inlet of the heat exchanger when the temperature of the refrigerant at the load is above a second threshold;

transferring heat from the refrigerant received at the first inlet to the refrigerant received at the second inlet when the temperature of the refrigerant at the load is above the second threshold; and directing the refrigerant received at the second inlet to the compressor after heat from the refrigerant received at the first inlet has been transferred to the refrigerant received at the second inlet when the temperature of the refrigerant at the load is above a second threshold.

11. The method of claim 10, further comprising closing a valve of the heat exchanger when the temperature of the refrigerant at the load is below the first threshold.

12. The method of claim 8, further comprising directing the refrigerant from the compressor to the load when the temperature of the refrigerant at the load is below the first threshold.

13. The method of claim 8, wherein the first threshold is 50 degrees Fahrenheit.

14. The method of claim 8, further comprising storing the refrigerant at a receiver.

15. A system comprising:

a high side heat exchanger configured to remove heat from a refrigerant;

a heat exchanger configured to receive the refrigerant at a first inlet and to direct the refrigerant received at the first inlet to an outlet;

a load configured to use the refrigerant from the outlet to remove heat from a space proximate the load;

a compressor configured to compress the refrigerant from the load; and a valve configured to direct the refrigerant from the compressor to a second inlet of the heat exchanger when a temperature of the refrigerant at the load is below a first threshold, the heat exchanger further configured to transfer heat from the refrigerant received at the second inlet to the refrigerant received at the first inlet.

16. The system of claim 15, wherein the valve is further configured to direct the refrigerant from the compressor to the high side heat exchanger when the temperature of the refrigerant at the load is above a second threshold.

17. The system of claim 15, wherein the heat exchanger is further configured to:

receive the refrigerant at a second inlet of the heat exchanger when the temperature of the refrigerant at the load is above a second threshold;

transfer heat from the refrigerant received at the first inlet to the refrigerant received at the second inlet when the temperature of the refrigerant at the load is above the second threshold; and direct the refrigerant received at the second inlet to the compressor after heat from the refrigerant received at the first inlet has been transferred to the refrigerant received at the second inlet when the temperature of the refrigerant at the load is above a second threshold.

18. The system of claim 17, wherein the heat exchanger comprises a valve configured to close when the temperature of the refrigerant at the load is below the first threshold.

19. The system of claim 15, wherein the valve is further configured to direct the refrigerant from the compressor to the load when the temperature of the refrigerant at the load is below the first threshold.

20. The system of claim 15, wherein the first threshold is 50 degrees Fahrenheit.

21. The system of claim 15, further comprising a receiver configured to store the refrigerant.

* * * * *